US005226183A

United States Patent [19]

Clark

[11] Patent Number: 5,226,183

[45] Date of Patent: Jul. 13, 1993

[54] BATH LIFT SYSTEM WITH STABILIZER

[76] Inventor: Gordon J. Clark, 3355 Nadine Cres, South, Mississauga, Ontario, Canada, L5A 3L4

[21] Appl. No.: 794,276

[22] Filed: Nov. 19, 1991

[51] Int. Cl.[5] ..... A47K 3/12

[52] U.S. Cl. ..... 4/560.001; 4/561.001; 4/562.001; 4/563.001; 4/565.001

[58] Field of Search ..... 4/560.1, 561.1, 562.1, 4/563.1, 564.1, 565.1, 566.1; 5/81.1; 248/500, 501, 680

[56] References Cited

U.S. PATENT DOCUMENTS

| | | | |
|---|---|---|---|
| 3,022,518 | 2/1962 | Hayden | 4/562.1 |
| 4,168,552 | 9/1979 | Austin | 4/564.1 |
| 4,628,550 | 12/1986 | Walton | 4/560.1 |

OTHER PUBLICATIONS

Sketch "A" showing sample as disclosed at trade show in Atlanta, Ga. in Nov. 1990.

*Primary Examiner*—Henry J. Recla
*Assistant Examiner*—David J. Walczak
*Attorney, Agent, or Firm*—Bereskin & Parr

[57] ABSTRACT

A bath lift system for use in transporting a person into a bathtub, has an adjustable stabilizer. The bath lift system has a chair unit, a base unit and a stabilizer which all interconnect and fit on to a bath tub. The bath lift may operate by a water powered hydraulic cylinder located on the chair unit. The hydraulic cylinder has a sleeve with extending brackets onto which a chair is attached. The sleeve swivels and can be raised or lowered into the bathtub by the person being bathed. The piston for the hydraulic cylinder is then attached to the base unit which has legs and suction cups for securing it in the bath tub. The stabilizer is secured to the base unit and is adopted to abut an upper edge of the bathtub. This should provide reliable stability as the stabilizing forces are transmitted perpendicularly between the stabilizer and the bath tub edge, without the stabilizer tending to slide horizontally. The stabilizer can be fitted with an abutment member adapted to abut the bath tub edge, and provide location notches for engaging the chair, to limit rotation of the chair, to enable a user to readily sit down on or rise up from the chair. The stabilizer can be adjustable both horizontally and vertically to fit different size bath tubs.

22 Claims, 5 Drawing Sheets

BATH LIFT SYSTEM WITH STABILIZER

FIELD OF THE INVENTION

This invention relates to a bath lift system with stabilizer for enabling a user to enter and exit a bathtub.

BACKGROUND OF THE INVENTION

It is frequently necessary to transport elderly or disabled bathers into a bathtub by means of a bath lift located in the tub. Water powered operation is a safe means of operation because no electricity is required, and it is convenient because the water source is already provided in the bathtub. The lift requires only that the person to be bathed enter the lift chair as it sits over the edge of the bathtub. The chair carrying that individual is rotated over the tub and the lift then does the work of lowering him into the tub or raising him up for showering and exiting the tub.

In order not to mar the bath tub, and enable the lift system to be readily installed and removed, it is common practice to provide the base unit with suction cups on the ends of legs. The suction cups, usually four, adhere to the base of the bath tub.

There has existed heretofore a serious problem of slippage of such a lift device relative to the tub during use by the bather. When the chair is swung out to one side, the cantilever action can cause the suction cups to slide sideways across the base, since suction cups do not provide good resistance to lateral or shear loads. This problem can cause potentially serious injury to the person being bathed, and often has necessitated the use of additional persons to assist with the bathing.

As a result of the problem of slippage of the bath lift relative to the bath tub, various attempts have been made to stabilize the bath lift to the tub by use, for example, of stabilizer bars extending from the base and affixed to the sides of the tub by means of suction cup devices. However, the basic mode of instability still remains. A cantilevered load applied when the chair is swung out, tends to rotate the whole unit about a longitudinal axis approximately in the centre of the bath tub. This applies shear loads to the suction cups which tend to slip. Thus, this stabilization scheme still does not provide sufficient security against rotation of the bath lift mechanism due to slippage of the suction cups along the wall of the tub as the load is being applied. Prevention of such rotation and slippage is very important as, for elderly or physically handicapped users, any small degree of instability can throw them from the lift, causing injury, or drowning as a result of immersion of the person's face which the person cannot prevent.

SUMMARY OF THE INVENTION

It is therefore an object of this invention to provide a bath lift with a stabilizer which prevents unwanted motion of the bath lift when the bather is entering or exiting the chair or otherwise operating the bath lift. It is desirable that stabilizing loads applied between a stabilizer and a surface of the bath tub are generally perpendicular to that surface, so as not to tend to make the stabilizer slide along the surface.

It is a further object of this invention to provide a bath lift system which requires no permanent attachments onto the bathtub and which is adjustable to fit a variety of bathtubs of different heights and widths.

It is a further object of this invention to provide a bath lift system which is easy to assemble and disassemble, is portable, and can be operated with or without an attendant present.

In one aspect the present invention provides a bath lift system which comprises:

(a) a lift which fits within a bathtub and is adapted to ascend and descend and to rotate in a horizontal plane above the edge of said bathtub;

(b) a base unit attached to said lift and securable to the floor of said bathtub to secure and locate the lift; and (c) a stabilizer, secured at one end to the base unit and having another end adapted for engaging an upper edge surface of the bath tub to stabilize the lift system and substantially prevent unwanted motion of the lift.

BRIEF DESCRIPTION OF DRAWINGS

For a better understanding of the present invention and to show more clearly how it may be carried into effect, reference will now be made, by way of example, to the figures which show a preferred embodiment of the present invention, and in which.

DETAILED DESCRIPTION OF THE PREFERRED EMBODIMENT

Figure 1:
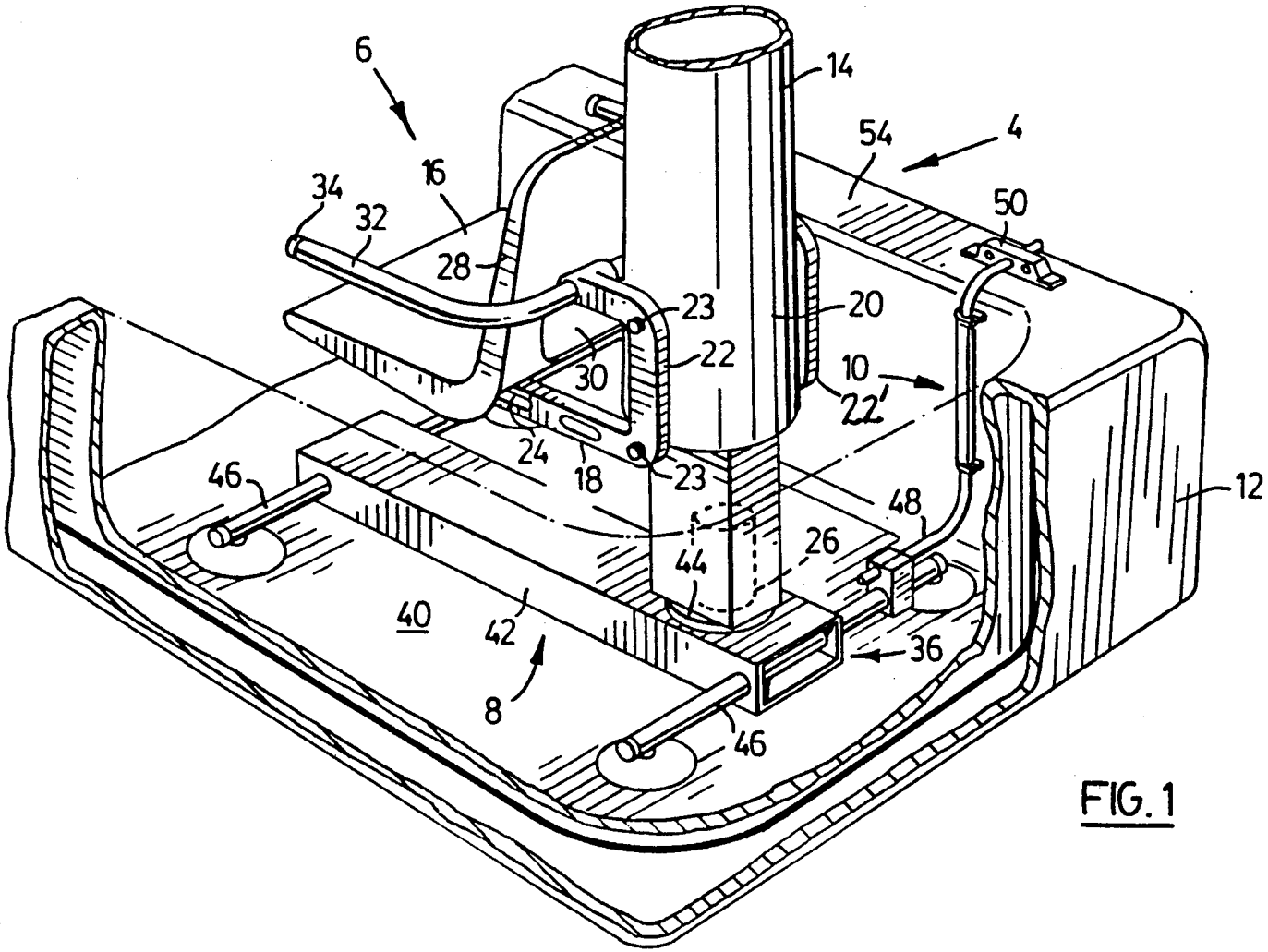
FIG. 1 is a perspective view of the bath lift system according to the invention.
Figure 2:
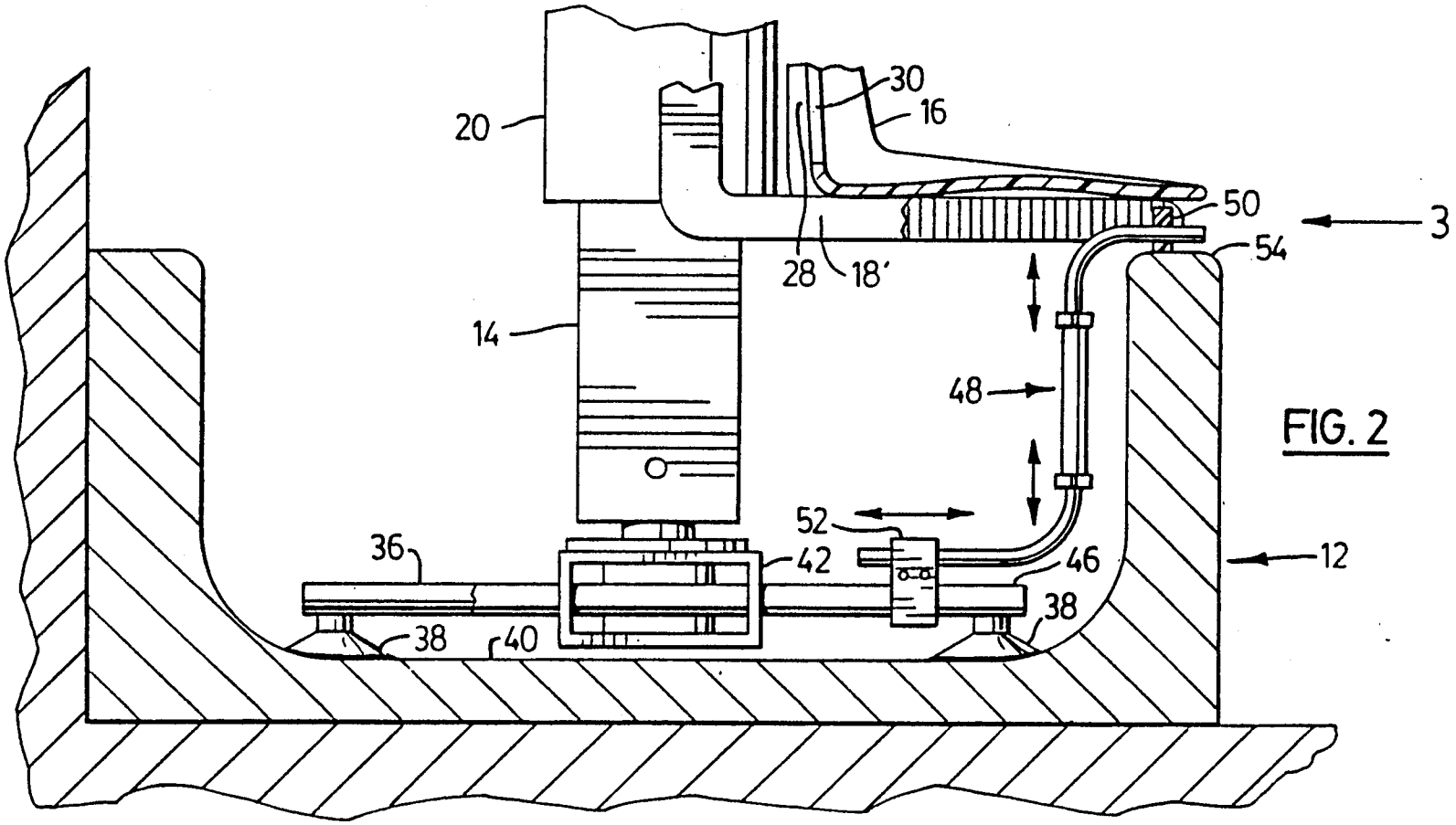
FIG. 2 is a partly sectional view of the bath lift system of FIG. 1 with the lift chair in position for entry or exit by the user.

Reference is made first to FIGS. 1 and 2 which show a bath lift system 4 according to the invention. The bath lift system 4 consists of a chair unit 6, a base unit 8 and a stabilizer 10. As explained more fully below, the three units of the bath lift system 4 are interconnected and fit into a bathtub 12. The bath lift system 4 is water powered by means of a hydraulic cylinder 14 which is located on the chair unit 6.

The hydraulic cylinder 14 is connected to the water faucet (not shown) in the bathtub 12. The water powered bath lift system 4 provides for manual rotational motion of a bath lift chair 16 in a horizontal plane in either direction of rotation. It also provides powered upward and downward movement of the chair 16.

The bath lift system 4 of the invention requires no permanent attachments to or alterations on the bathtub 12. It is completely portable and adjustable to bathtubs 12 of differing widths and heights.

The chair unit 6 consists of a chair 16 which is attached to a pair of brackets 18. The brackets 18 extend from the sleeve 20 of the hydraulic cylinder 14 which extends upright behind the chair 16. The brackets 18 are identical except that one is left-handed and the other is right-handed. The sleeve 20 of the hydraulic cylinder 14 has bolted to it on either side of the hydraulic cylinder 14 a left-hand casting 22 and a right-hand casting $22^1$ located at the same vertical distance axially along the sleeve 20 of the hydraulic cylinder 14. The left-hand casting 22, as shown in FIG. 1, is formed integral with the left-hand bracket 18, and the right-hand casting $22^1$ is formed integral with the right-hand bracket $18^1$. The sleeve can rotate relative to a piston end of the hydraulic cylinder 14 and can move up and down, the lower end of the piston being shown at 26.

The castings 22 and $22^1$ each extend vertically along a portion of the lower section of the sleeve 20 of the hydraulic cylinder 14 and are each bolted by bolts 23 to the sleeve 20 at the base of the sleeve 20, and again at an identical vertical distance along the axis of the sleeve 20 on either side of the hydraulic cylinder 14 at the top of the castings 22 and $22^1$. Each of the castings 22 and $22^1$ curve at the base of the sleeve 20 and extend forward of the hydraulic cylinder 14 to form the bracket 18 which extends at approximately right angles from the base of the hydraulic cylinder 14. Each bracket 18 has a plurality of apertures 24.

The chair 16 is preferably made of plastic and has a moulded and contoured seat back 28 having an oblong aperture 30 in the center of the lower seat back 28. The top of the chair 16 curves backward so that when the chair 16 is placed on the brackets 18 forward of the hydraulic cylinder 14, the top of the chair rests on the sleeve 20 of the hydraulic cylinder 14. Thus when the user sits in the chair 16, the hydraulic cylinder 14 will be directly behind him.

The chair 16 is screwed onto the brackets 18, preferably in two places on each bracket 18. The chair 16 has two independent swing up arms 32. Each arm 32 comprises a generally straight tube having an L-shaped curve at one end where it joins the sleeve 20. Each arm 32 fits by a press fit into the left-hand or right-hand casting 22 and $22^1$ by means of a circular hole (not shown) in each casting 22 and $22^1$. The arms 32 are preferably made of a light material, such as aluminum. Epoxy paint applied to the hole in the castings 22 and $22^1$ facilitates upward rotation of the arms 32 when force is applied. The arms 32 rotate upward about a line in the plane of the seat back 28 so that the tip 34 of the arm 32 points toward the ceiling. With either one of the arms 32 in this position, the user can make an unobstructed lateral transfer from, for example, a wheelchair onto the bath lift chair 16. Once seated in the chair 16, the user can lower the arm 32 back to its original position so that the arm 32 can be utilized for resting the user's arm thereupon. In the preferred embodiment, one of the arms 32 is provided with a control valve (not shown) which controls the upward and downward movement of the chair 16. It will be appreciated by those skilled in the art that a variety of arms 32, such as fixed arms, can be provided, or arms could be absent from the chair 16.

The base unit 8 consists of an H-shaped frame 36 having disposed thereon four suction cups 38. The frame 36 is attached to the floor 40 of the bathtub 12 by means of the suction cups 38. The frame 36 has a rectangular center bar 42 having a round cavity 44 and two legs 46 located at either end of the center bar 42. The cavity 44 is located on the upper face of the center bar 42 and is adapted to accept the lower end of the piston 26 by a press fit. The cavity 44 is fitted with a bushing (not shown) for secure engagement with the piston end 26. The cavity 44 is located centrally in the traverse direction of the center bar 42 nearer to one leg 46 of the frame 36, to form the back end of the bath lift system.

The legs 46 are disposed at right angles through the side faces of the center bar 42. The legs 46 extend an equal distance on either side of the center bar 42. The legs 46 are each located an equal distance axially from the ends of the center bar 42. The legs 46 are each fastened to the center bar 42 by a nut and bolt (not shown) disposed at the intersection of the legs 46 with the center bar 42.

Disposed on either end of each leg 46 below said leg 46 are four suction cups 38 which grip the floor 40 of the bathtub 12.

The chair unit 6 fits by a press fit into the base unit 8 by pressing the piston end 26 into the cavity 44. The base unit 8 and the chair unit 6 can easily be detached without use of any tools by simply lifting up on the chair unit 6.

In accordance with the present invention, a stabilizer 10 consists of an S-shaped tube 48, a swivel lock 50 and a clamp 52. When placed in the bath lift system 4, the swivel lock 50 rests on the upper edge 54 of the bathtub 12 with the S-shaped tube 48 disposed therein and attached to the base unit 8.

Figure 3:
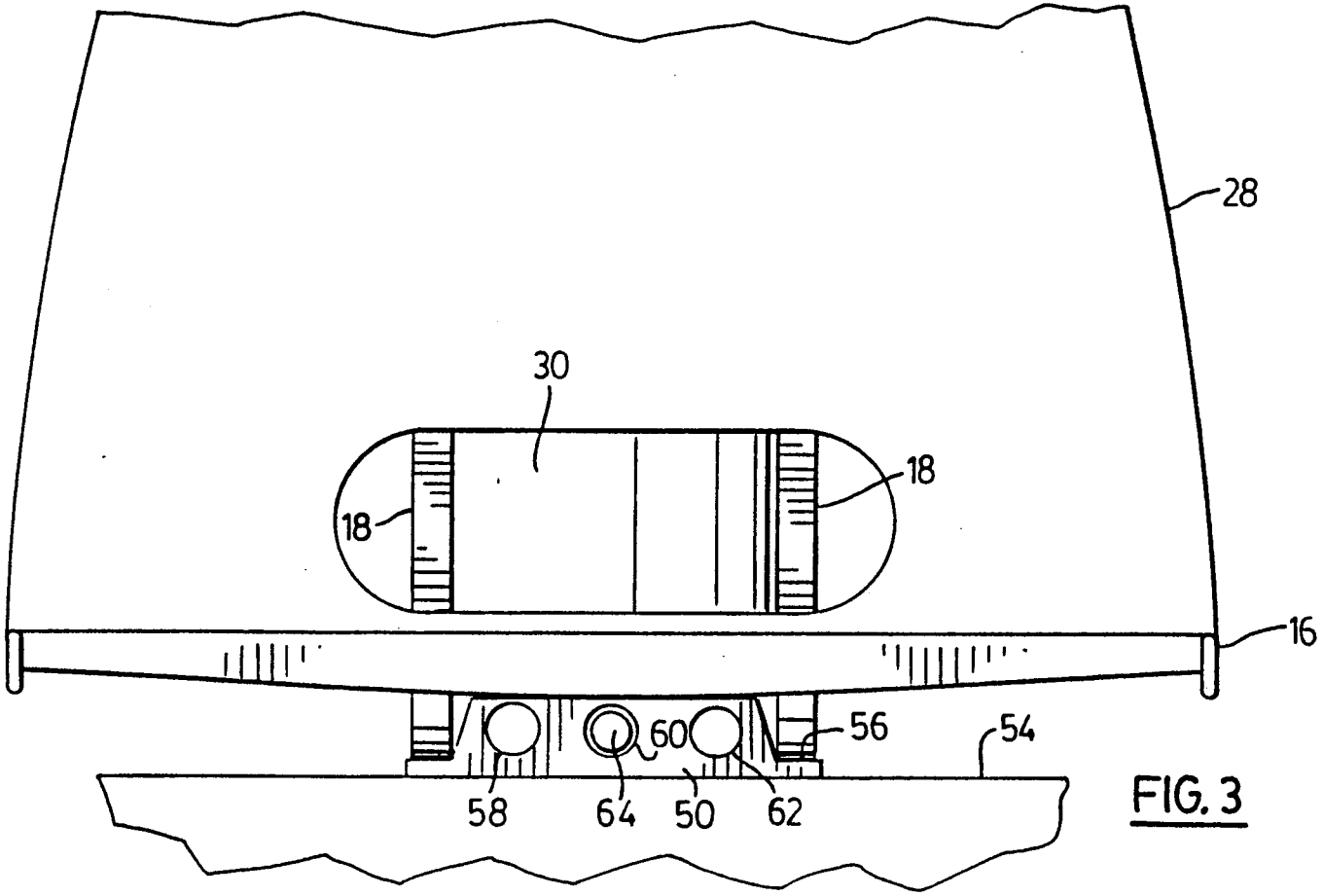
FIG. 3 is a side elevation view of the bath lift system of FIG. 2 looking in the direction of arrow 3 of FIG. 2.
Figure 4:
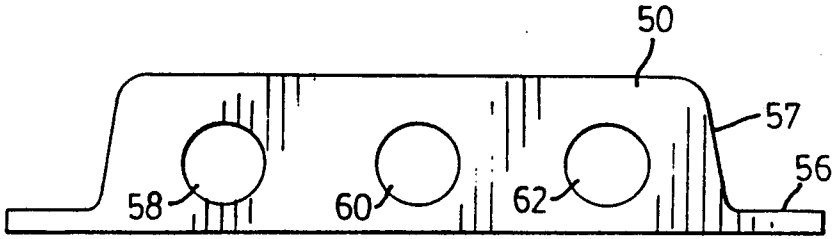
FIG. 4 is a side elevation view of the swivel lock of the invention.

As best shown in FIGS. 3 and 4, the swivel lock 50 is a generally rectangular member preferably made of plastic and having a flat bottom surface. The swivel lock 50 has two flattened shoulders 56 adjacent the bottom surface on either side of the swivel lock 50. The top surface is substantially flat and tapered side surfaces 57 extend downward toward each shoulder 56. The swivel lock 50 also contains three round passages 58, 60 and 62 disposed through its thickness; the direction of the axis of each passage 58, 60 and 62 is in the transverse direction of the edge 54 of the bathtub 12 when the swivel lock 50 is in position. One passage 60 is in the center of the swivel lock 50, and the other two passages 58 and 62 are located at either side of the center passage 60. The passages 58, 60 and 62 are located at the same vertical distances from the flat bottom surface of the swivel lock 50.

Figure 5B:
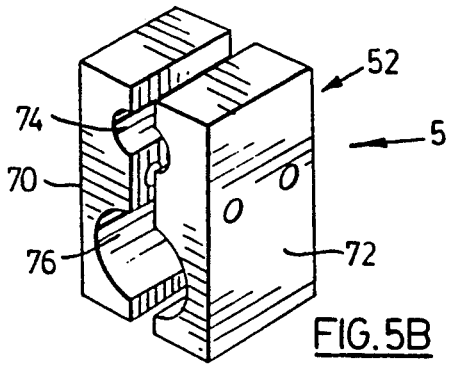
FIG. 5B is a side elevation view of the clamp of the stabilizer unit.
Figure 5A:
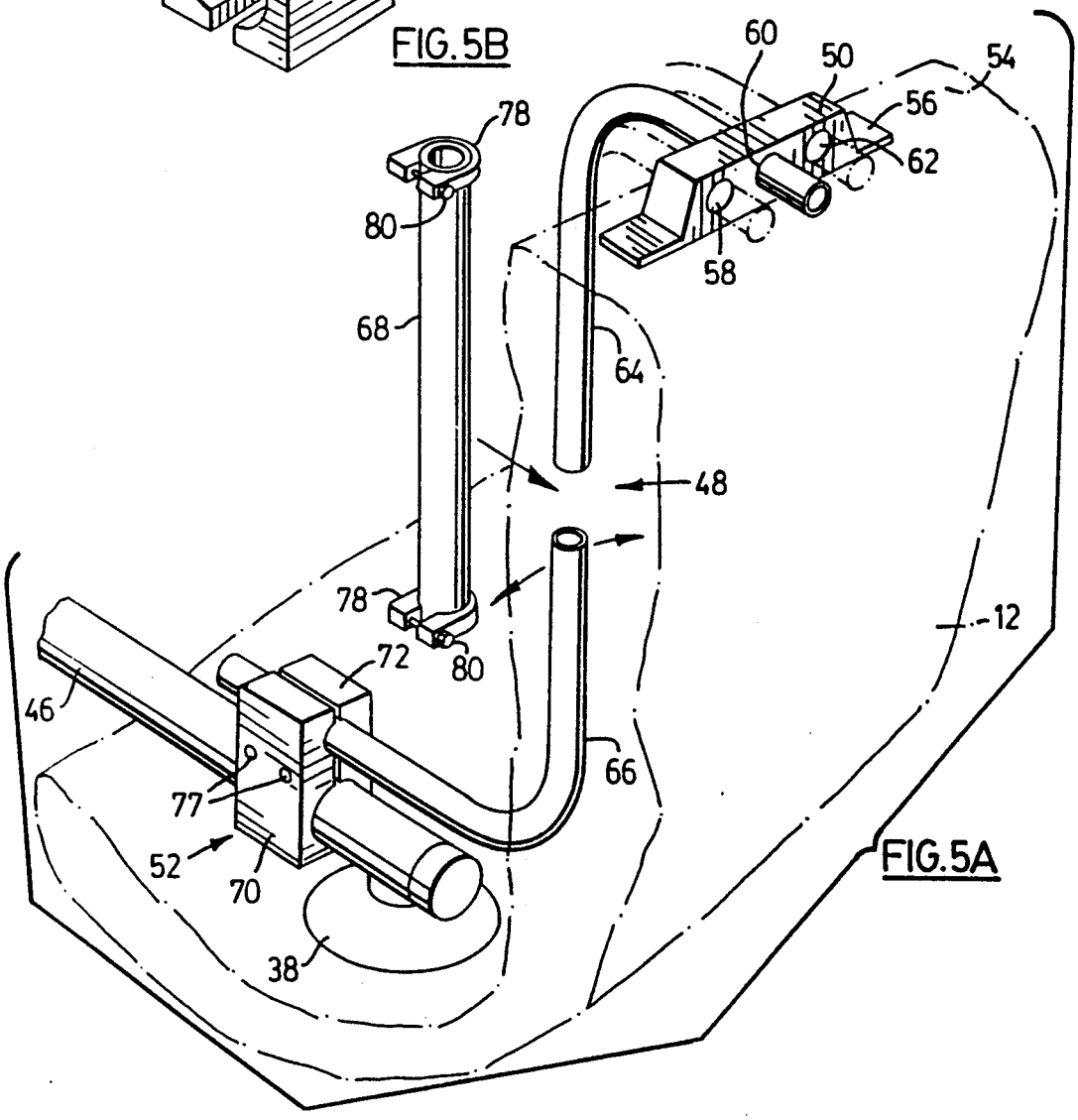
FIG. 5A is a partly sectional exploded view of the stabilizer of the bath lift system.

As best shown in FIG. 5A, the S-shaped tube 48 has a generally circular cross section and has three discrete portions: an upper tube 64, a lower tube 66 and a height adjuster tube 68 disposed between the upper tube 64 and the lower tube 66. The end of upper tube 64 is substantially straight and is adapted to slip through selectively one of the three passages 58, 60 or 62 in the swivel lock 50 and be held in place by a press fit between the outer wall of the end of the upper tube 64 and the passage 58, 60 or 62, so that the tip of the upper end extends through the passage a short distance forward of the swivel lock 50. The lower end of upper tube 64 extends vertically.

The lower tube 66 has a substantially straight lower end and is adapted to fit into a clamp 52. The clamp 52 consists of a left half 70 and a right half 72, as best illustrated in FIG. 5B. The two halves 70 and 72, when co-joined, form an upper circular passage 74 and a lower circular passage 76 through the clamp 52. The upper passage 74 is adapted for gripping the outer wall of the lower tube 66. The lower passage 76 is adapted for gripping the outer wall of the leg 46 of the frame 36. The two halves, 70 and 72, each have two sets of matching passages, one threaded and one not threaded in known manner (not shown), which extend through the two halves 70 and 72 in the direction of arrow 5 in FIG. 5B. The two sets of matching internal threaded passages are disposed side by side, with parallel axes, and are disposed between the upper passage 74 and the lower passage 76. The two halves 70 and 72 are secured together by means of two Allen head screws 77 imposed through the two matching threaded passages, and mated to said passage. It will be appreciated by those skilled in the art that a variety of means of fastening the clamp 52 are possible. The clamp 52 structure permits adjustment of the width of the bath lift system 4 to accommodate bathtubs 12 of varying widths. To select a desired width, the clamp 52 is loosened by unscrewing the screws 77, and sliding the lower tube 66 laterally, followed by tightening of the Allen screws 77.

The height adjuster tube 68 is located between the upper tube 64 and the lower tube 66 of the S-shaped tube 48. The height adjuster tube 68 consists of a substantially straight tube having two ends. The height adjuster tube 68 is hollow and has a generally circular cross section and two identical clamps 78 surrounding the ends of said height adjuster tube 68. The ends of the tube 68 are split. The clamps 78 consist of thin U-shaped members which surround each end of the height adjuster tube 68. Each clamp 78 is secured to the height adjuster tube 68 by means of a screw 80 disposed through the clamp 78 at the top of the "U". The screw 80 bisects the clamp 78 in a direction at right angles to the center axis of the height adjuster tube 68. The height adjuster tube 68 has a diameter slightly greater than that of the upper tube 64 and the lower tube 66 of the S-shaped tube 48, so that when all three parts of the S-shaped tube 48 are joined, the height adjuster tube 68 fits overtop the upper tube 64 and the lower tube 66. To shorten the height of the S-shaped tube 48, the clamps 78 are loosened and an additional axial portion of the upper tube 64 and/or lower tube 66 of the S-shaped tube is inserted into the height adjuster tube 68, and vice versa to lengthen the height of the S-shaped tube 48. The clamps 78 are then tightened. In this manner, the stabilizer unit 10 can attain a variety of different heights to accommodate bath tubs 12 of varying heights. It will be appreciated by those skilled in the art that other means of securing the height adjuster tube 68 onto the upper tube 64 and lower tube 66 can be employed.

The control valve (not shown) for the bath lift system 4 is located on the left or right arm 32 of the chair 16 for ease of operation by the system user. There is also provided a diverter valve (not shown) connectible to the shower spout or tube spout of the bathtub 12. The control valve and diverter valve, for raising and lowering the lift, could be of conventional construction.

When the user wants to move, for example, from a wheelchair into the bath lift system 4, he raises the chair 16 with the cylinder 14 to above the edge of the bath tub, and then rotates the chair 16 manually until it lies over the edge 54 of the bathtub 12. He then lowers the chair 16 slightly so that it engages the lock 50. When the chair 16 is in the correct position for entry, the chair 16 will be held in place by engagement of the brackets 18 with the shoulders 56 of the swivel lock 50. The tapered side surfaces 57 guide the chair 16 and brackets 18 onto the lock 50, even if the chair 16 is not perfectly aligned.

The user can then lift the arm 32 of the chair 16 and climb onto the chair 16 safely. As the user's weight is applied to the chair, either with the chair 16 resting on the lock 50 or raised above it, the resultant cantilevered load is applied through the S-shaped tube 48 to the tub edge 54, so there is little or no load tending to displace the lock 50 horizontally. In any event, limited horizontal slippage of the lock 50 is acceptable. For example, if the tub edge 54 is wet or otherwise slippery, slight movement of the lock 50 either inwardly or outwardly is acceptable, as the lock 50 will still rest on the tub edge 54 and such movement does not affect stability. The engagement of the chair 16 with the lock 50 prevents unwanted rotation of the chair 16 as a user enters or exits the chair 16. Further, the shoulders 56 distribute the load to the bath tub edge 54 and prevent the brackets 18 marking the tub edge 54. Known designs rely entirely on friction between the chair 16 and tub edge 54 which is not very reliable, and can lead to the chair 16 rotating away from the user, causing the user to fall and possibly injure him or herself. Further, it is possible that support brackets for the chair could mark the tub edge. With the user in the chair 16, the arm 32 is lowered. He then operates the control valve so that the chair 16 ascends, and subsequently rotates the chair until his torso is above the floor 40 of the bathtub 12. The user then employs the control valve to raise or lower the chair 16 to shower or bathe as desired.

To exit the bath tub, the procedure is essentially the reverse of that detailed above. Again the stabilizing S-shaped tube 48 and lock 50 stabilize the lift system and secure the chair 16 as the user leaves the chair 16.

Figure 6:
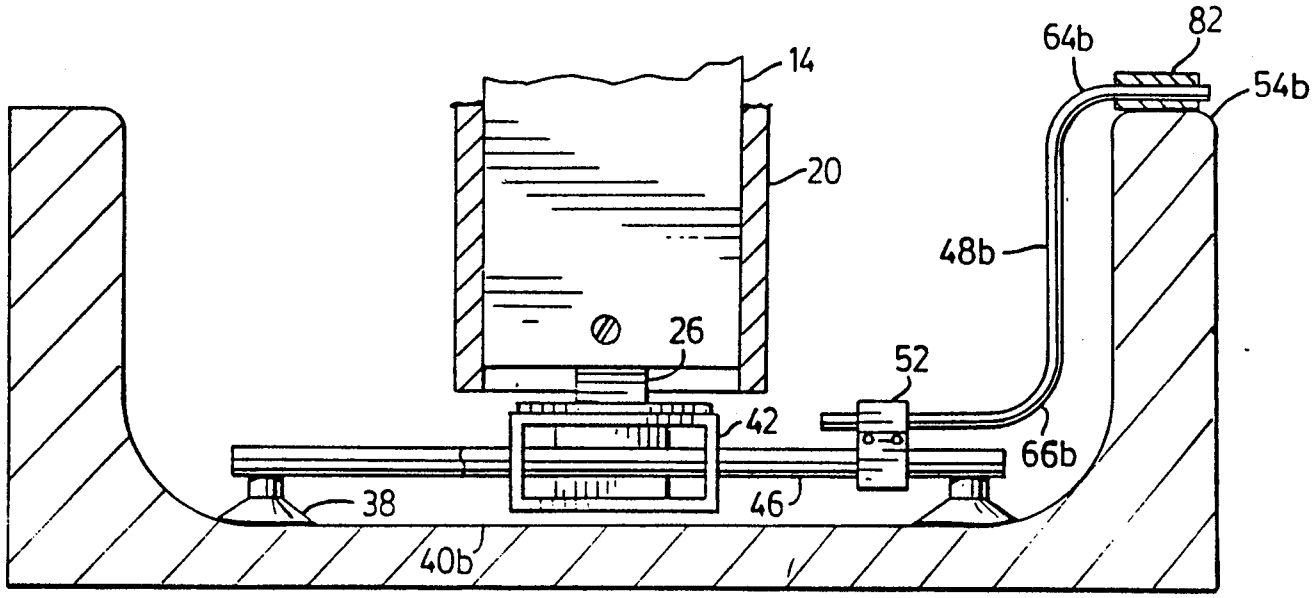
FIG. 6 is a side elevation view from the back of another embodiment of the bath lift system.

FIG. 6 shows a variation of the bath lift system of FIGS. 1-5B. Reference numerals with the suffix "b" indicate corresponding parts. The S-shaped tube 48*b* is formed wholly of one piece and the lock is replaced by a plastic sleeve 82 located axially along the upper tube 64*b* of said S-shaped tube 48*b*. The plastic sleeve 82 fits snugly around said upper tube 64*b*. The lower tube 66*b* portion of said S-shaped tube 48*b* is disposed in the clamp 52 as previously described. The plastic sleeve 82 prevents transverse movement along the edge 54 of the bathtub 12, and protects said edge 54 from scratches imposed by the outer wall of the S-shaped tube 48*b*. Further, although the sleeve does not lock the chair 16 as does lock 50, and does not cushion the brackets 18, it can limit the range of movement of the chair 16. This embodiment can be produced economically in a standard size to accommodate standardized bathtubs. This embodiment facilitates ease of use of the bath lift system because the height of the S-shaped tube 48*b* need not be adjusted.

As mentioned above, the upper tube 64 can be fitted into any one of the passages 58, 60, 62. Each passage 58, 60, 62 will give slightly different locked positions for the chair 16. Depending on the installation and the desirability of having the chair 16 facing slightly to one side in the locked position, an appropriate one of the passages 58, 60, 62 can be selected during installation.

I claim:

1. A bath lift system adapted for use in a bathtub, including a floor, which comprises:

(a) a lift which fits within said bathtub and is adapted to ascend and descend and to rotate in a horizontal plane above an edge of the bathtub, and includes a chair;

(b) a base unit attached to said lift and securable to the floor of the bathtub to secure and locate the lift;

(c) a stabilizer secured at one end to the base unit and having another end adapted for engaging an upper edge surface of the bath tub without permanent attachment to stabilize the lift system and substantially prevent unwanted motion of the lift; and (d) a lock mounted on the other end of the stabilizer for engaging a bath tub upper edge surface and adapted to engage the chair when the chair is rotated above the edge of the bathtub, to restrict rotational movement of the chair during entry into and exit from the chair, the lock and the chair having complementary locking surfaces.

2. A bath lift system as claimed in claim 1, wherein the lock comprises a resilient, cushioning material for cushioning the stabilizer relative to the edge of the bath tub.

3. A bath lift system as claimed in claim 2, which includes means for adjusting the other end of the stabilizer both horizontally and vertically.

4. A bath lift system as claimed in claim 2, wherein said lock is generally rectangular in plan, and includes the flat lower face for abutting said edge surface of the bath tub, and wherein the lock includes at least one cavity engaged by the other end of the stabilizer.

5. A bath lift system as claimed in claim 4, wherein the lock includes a plurality of cavities horizontally spaced from one another, and wherein the other end of the stabilizer can be engaged with a selected one of the cavities by a press fit, to enable the lateral position of the lock relative to the other end of the stabilizer to be adjusted.

6. A bath lift system as claimed in claim 5, wherein the chair includes a pair of brackets extending beneath a seat of the chair, and wherein the lock includes shoulders at either end stepped down from a main body of the lock and tapered sides extending down to the shoulders, which sides and shoulders are spaced to engage the brackets of the chair to locate the chair.

7. A bath lift system as claimed in claim 4, wherein the chair includes a pair of brackets extending beneath a seat of the chair, and wherein the lock includes shoulders at either end stepped down from a main body of the lock and tapered sides extending down to the shoulders, which sides and shoulders are spaced to engage the brackets of the chair to locate the chair.

8. A bath lift system as claimed in claim 7, which includes at least one vertical adjustment means for adjusting the vertical position of the other end of the stabilizer, and horizontal adjustment means for adjusting the horizontal position of the other end of the stabilizer.

9. A bath lift system as claimed in claim 8, wherein the stabilizer is general S-shape, with the ends thereof extending generally horizontally, wherein the base unit includes legs extending horizontally out therefrom, and wherein said horizontal adjustment means comprises adjustable clamping means clamping the one end of the stabilizer to a leg of the base unit, and wherein both the stabilizer and the legs of the base unit are of generally circular section, and wherein said clamping means comprises complementary left and right hand halves, each of which include corresponding semi-circular recesses which together define circular passages for the one end of the stabilizer and a leg of the base unit, and wherein the left and right hand halves include bores for screw fasteners, the bores in one half being plain and the bores in the other half being threaded, with corresponding screw fasteners being engaged in those bores.

10. A bath lift system as claimed in claim 9, wherein the lock is formed of plastic, and wherein the stabilizer comprises a stainless steel tube.

11. A bath lift system as claimed in claim 9, wherein the stabilizer comprises upper and lower tubes, which include vertical end parts that slideably engage one another, to permit vertical adjustment of the stabilizer, and a clamp clamping the upper and lower tubes together.

12. A bath lift system as claimed in claim 9, wherein the stabilizer comprises an upper tube, a lower tube and height adjustment tube connecting the upper and lower tubes, the height adjustment tube, having two opposite ends, being generally straight and vertical and being slideably engaged with the upper and lower tubes, and wherein the stabilizer includes clamps for clamping the height adjustment tube to the upper and lower tubes after adjustment of the vertical height of the stabilizer.

13. A bath lift system as claimed in claim 12, wherein the clamps of the stabilizer encircle the ends of the height adjustment tube and include screw fastening means for clamping the height adjustment tube and the upper and lower tubes together.

14. A stabilizer as claimed in claim 8, wherein the stabilizer is generally S-shaped and the ends thereof extend generally horizontally, wherein the base unit includes a horizontally extending leg and the horizontal adjustment means comprises a clamp securing the one end of the stabilizer to the leg of the base unit, and wherein the stabilizer comprises at least two parts providing the vertical adjustment means, the vertical adjustment means including clamping means for clamping and securing the parts of the stabilizer together and wherein the lock includes a plurality of cavities horizontally spaced from one another, and wherein the other end of the stabilizer can be engaged with a selected one of the cavities by a press fit, to enable the lateral position of the lock relative to the other end of the stabilizer to be adjusted.

15. A bath lift system as claimed in claim 4, wherein the lock is formed of plastic, and wherein the stabilizer comprises a stainless steel tube.

16. For use with a bath lift system which comprises: a base unit securable to a bath tub including a floor; a lift attached to the base unit, which lift fits within a bath tub and is adapted to ascend and descend and to rotate in horizontal plane above the edge of the bath tub; and a chair mounted on the lift;

a stabilizer comprising an elongate member having first and second ends; a clamp means for securing the first end of the stabilizer to the base unit of the bath lift system; and a lock engaged on the second end of the stabilizer, the stabilizer being configured so that, when attached to said base unit, the lock abuts an upper edge of a bath tub to stabilize the bath lift system, with the lock cushioning the contact between the stabilizer and the bath tub edge surface, the lock having a locking surface adapted to complementarily engage a rocking surface on the chair, when the chair is rotated above the edge of the bath tub, to restrict rotational movement of the chair during entry into and exit from the chair.

17. A stabilizer as claimed in claim 16, wherein the lock comprises a resilient cushioning material.

18. A stabilizer as claimed in claim 17, wherein the lock has a generally flat lower surface for abutting a bath tub edge surface, is generally rectangular in plan and includes shoulders at either end stepped down from a main body of the lock, the shoulders being adapted to engage chair brackets and wherein the lock includes a plurality of passages horizontally spaced apart extending therethrough, with the second end of the stabilizer being selectively engageable in one of said passages, to vary the relative horizontal location of the lock.

19. A stabilizer as claimed in claim 18, wherein the stabilizer is generally S-shaped with the first and second ends extending substantially horizontally and wherein the clamping means comprises two-part clamps having complementary left and right hand parts and screw fasteners securing the parts together, the clamping means being adapted to engage and clamp the first end of the stabilizer and a horizontal leg of a base unit.

20. A stabilizer as claimed in claim 16, wherein the stabilizer is generally S-shaped with the first and second ends extending substantially horizontally and wherein the clamping means comprises two-part clamps having complementary left and right hand parts and screw fasteners securing the parts together, the clamping means being adapted to engage and clamp the first end of the stabilizer and a horizontal leg of a base unit.

21. A bath lift system, adapted for use in bath tub including a floor and mounted on a generally horizontal plane defining a horizontal direction and a corresponding vertical direction perpendicular thereto which comprises:

(a) a lift which fits within the bath tub, is adapted to ascend and descend and rotate in a horizontal plane above the edge of the bath tub, and includes a chair;

(b) a base unit attached to said lift and securable to the floor of a bath tub to secure and locate the lift;

(c) a stabilizer secured at one end to the base unit having another end adapted for engaging an upper edge surface of the bath tub without permanent attachment to stabilize the lift system and substantially prevent unwanted motion of the lift, the stabilizer comprising upper and lower tubes which include a sliding vertical connection for adjusting the stabilizer vertically, and the stabilizer including a clamp at said one end for securing the stabilizer to the base unit and for effecting adjustment of the horizontal position of the stabilizer; and a lock mounted on the other end of the stabilizer for engaging a bathtub upper edge surface and adapted to engage the chair when the chair is rotated above the edge of the bathtub, to restrict rotational movement of the chair during entry into and exit from the chair, the lock and the chair having complementary locking surfaces.

22. A bath lift system as claimed in claim 21, wherein the horizontal adjustment means comprises adjustable clamping means having complementary left and right hand halves, which are shaped to receive said one end of the stabilizer and an element of the base unit, and which includes screw fasteners for clamping the complementary halves together, and wherein the stabilizer comprises an upper tube, a lower tube, and a height adjustment tube connecting the upper and lower tubes, the height adjustment tube being generally straight and vertical and being slideably engaged with the upper and lower tubes, the stabilizer including clamps for clamping the height adjustment tube to the upper and lower tubes.

* * * * *